US005441028A

United States Patent [19]

Felhofer

[11] Patent Number: 5,441,028

[45] Date of Patent: Aug. 15, 1995

[54] FUEL INJECTION DEVICE FOR INTERNAL COMBUSTION ENGINES

[75] Inventor: Hubert Felhofer, Aigen, Austria

[73] Assignee: Robert Bosch GmbH, Stuttgart, Germany

[21] Appl. No.: 184,162

[22] Filed: Jan. 19, 1994

[30] Foreign Application Priority Data

Jan. 30, 1993 [DE] Germany ..... 43 02 668.0

[51] Int. Cl.[6] ..... F02M 51/08; F02M 69/04

[52] U.S. Cl. ..... 123/456; 123/467; 239/96

[58] Field of Search ..... 123/456, 467, 446, 447; 239/533.3, 585.1, 585.2, 584, 96

[56] References Cited

U.S. PATENT DOCUMENTS

| | | | |
|---|---|---|---|
| 3,464,627 | 9/1969 | Huber | 239/96 |
| 3,610,529 | 10/1971 | Huber | 239/96 |
| 4,221,192 | 9/1980 | Badgley | 123/456 |
| 4,628,881 | 12/1986 | Beck et al. | 239/96 |
| 4,759,331 | 7/1988 | Sausner | 123/472 |
| 4,909,440 | 3/1990 | Mitsuyasu et al. | 123/467 |
| 4,948,049 | 8/1990 | Brisbon et al. | 239/96 |
| 4,993,637 | 2/1991 | Kanesaka | 239/96 |
| 5,012,786 | 5/1991 | Voss | 123/467 |
| 5,168,857 | 12/1992 | Hickey | 123/472 |
| 5,176,120 | 1/1993 | Takahashi | 123/446 |
| 5,197,438 | 3/1993 | Yamamoto | 123/456 |
| 5,230,613 | 7/1993 | Hilsbos et al. | 123/456 |

FOREIGN PATENT DOCUMENTS

| | | |
|---|---|---|
| 3436768 | 11/1990 | Germany . |
| 1292761 | 10/1972 | United Kingdom . |
| 1411053 | 10/1975 | United Kingdom . |
| 1422422 | 1/1976 | United Kingdom . |
| 2079366 | 1/1982 | United Kingdom . |

*Primary Examiner*—Thomas N. Moulis

*Attorney, Agent, or Firm*—Edwin E. Greigg; Ronald E. Greigg

[57] ABSTRACT

A fuel injection device for internal combustion engines having a high pressure fuel pump driven by the engine. The pump supplies high pressure fuel to a pressure storage chamber, which chamber, for its part, communicates with injection valves that protrude into the combustion chamber of the engine to be supplied. To achieve precise control of the injection times and injection quantities, the injection valve is directly triggered by a magnet valve, to which end the valve needle of the injection valve is embodied as the valve member of the magnet valve. In order to be able to precisely control very small injection quantities and times (for example pre-injection), the adjusting forces of the valve needle are minimized, to which end the valve needle is pressure balanced in every operating state of the injection valve by directing the high fuel pressure after the start of the valve needle opening stroke also onto the face end of the valve needle remote from the valve needle seat.

17 Claims, 2 Drawing Sheets

FIG. 1
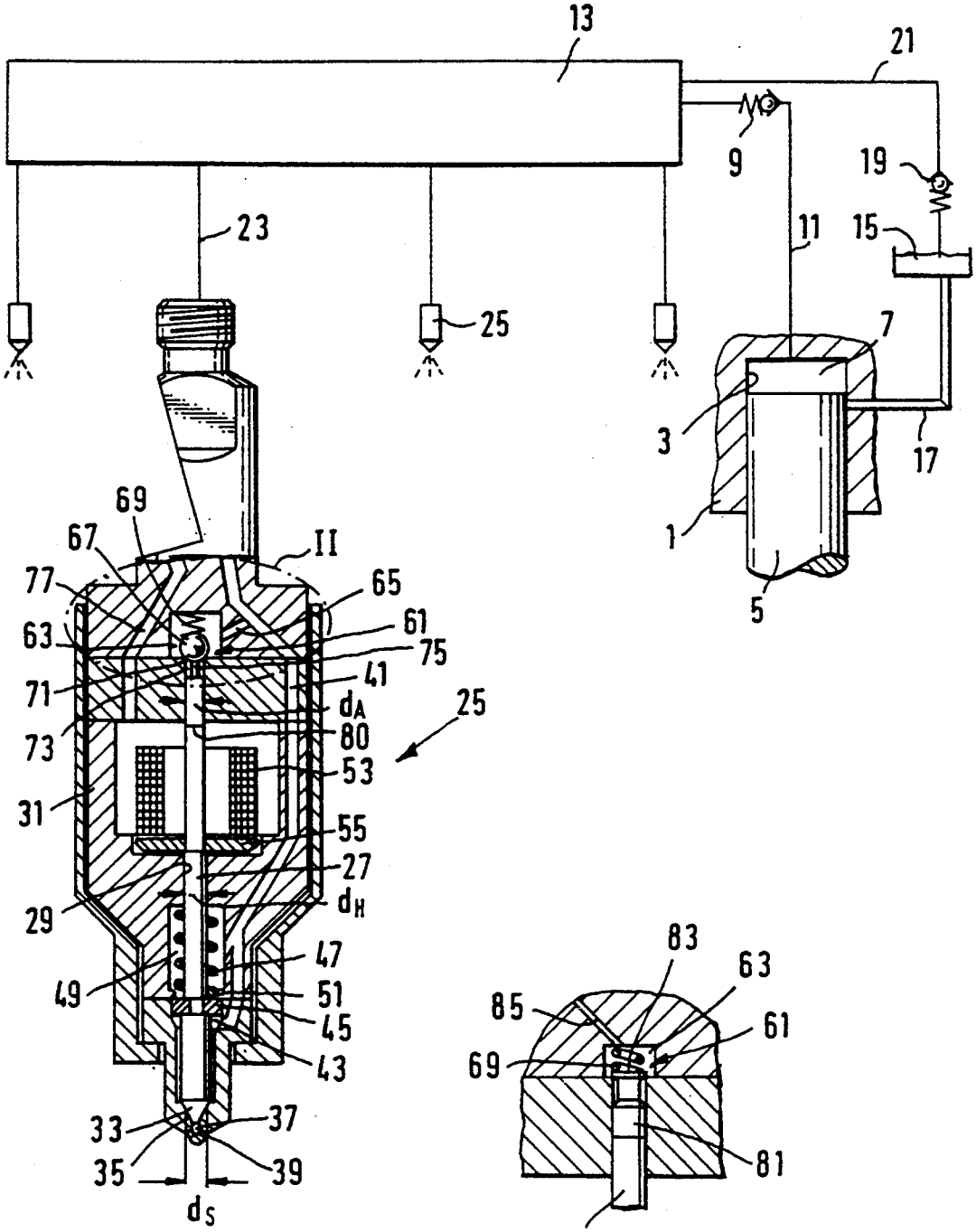
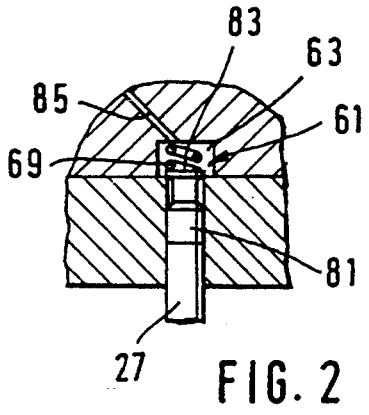
FIG. 2

FUEL INJECTION DEVICE FOR INTERNAL COMBUSTION ENGINES

BACKGROUND OF THE INVENTION

The invention is based on a fuel injection device for internal combustion engines as defined hereinafter. In a fuel injection device of this kind, known from German Patent 34 36 768, which serves to supply fuel to an internal combustion engine, a high pressure fuel pump, which is embodied as a piston pump, fills a pressure storage chamber with fuel via a high pressure line. Fuel injection lines lead from this pressure storage chamber to the individual fuel injection valves, which communicate with each other in common rail fashion; the pressure storage chamber is kept at a defined pressure by means of a pressure control device so that the injection pressure at the injection valves can be predetermined over the entire operational performance range of the engine to be supplied, independent of engine speed.

To control the injection times and quantities at the injection valve, an electrically actuated valve is inserted in each injection line, and with its opening and closing, controls the high pressure fuel delivery to the injection valve.

Upon opening of the electrical control valve, the fuel under high pressure flows into the injection valve, lifts a valve needle from its seat counter to the force of a valve spring, thus opening the injection valve, and the fuel is injected. The injection is brought to an end by means of the closing of the electrical control valve, which as a result causes the pressure in the injection valve to drop below the injection pressure, so that the restoring force of the valve spring brings the valve needle into contact with the valve seat.

The known fuel injection device has the disadvantage that the time of the injection onset and the time of the end of injection cannot be controlled precisely enough, since the time of the opening or closing motion of the electrical control valve is not identical to the start of the needle stroke of the injection valve, but deviates from it depending upon inertia as a result of the hydraulic connection between the two valves.

For modern internal combustion engines, however, in order to achieve an optimal mixture preparation and combustion, it is necessary to precisely adhere to the parameters of the injection time and duration, which cannot be reliably guaranteed with the known fuel injection device. Furthermore in the known invention, as a result of the inertia-encumbered triggering of the injection valve, with its necessarily very short switching times, it is not possible to sufficiently control a pre-injection quantity, which is of the utmost importance in connection with a reduction of the engine noise.

OBJECT AND SUMMARY OF THE INVENTION

The fuel injection device according to the invention has the advantage over the prior art that an inertia-encumbered transmission of the opening signal from the control valve to the injection valve is reliably avoided by means of the direct triggering of the valve needle of the injection valve by means of the electrically controlled valve. It is especially advantageous to embody the valve needle of the injection valve as a valve member of the electrical control valve, which, in addition to a simple realization of the direct triggering of the injection valve, also dispenses with the need for one additional element.

In order to be able to embody the electrical control valve, which is advantageously embodied as a magnet valve, in as small a fashion as possible, the valve needle in the fuel injection device according to the invention is pressure balanced for each operating state of the injection valve, so that the adjusting forces of the magnet valve merely have to overcome the restoring force of a valve spring, regardless of the high pressure. In this manner, it is possible to keep the dimensions of the magnet valve small and, as a result of the attendant low inertia of the valve closing member, to reliably guarantee very short switching times for a pre-injection.

The realization of pressure balancing of the valve needle in every operating state of the injection valve can be achieved in an advantageous matter via an additional pressure valve, which is pushed open by the valve needle at the beginning of the opening stroke and which conducts the high fuel pressure from the injection line to the face end of the valve needle remote from the valve seat. The face ends of the valve needle are sized and embodied so that the valve needle is pressure balanced in each operating state. In place of the pressure valve, a magnet valve can be advantageously inserted in a connecting line between the high pressure injection line and the face end of the valve needle remote from the valve seat, which magnet valve, analogously to the pressure valve, conducts the high fuel pressure at the start of the valve needle opening stroke to the valve needle's face end remote from the valve seat. A forced closing of the injection valve can be achieved by means of the magnet valve when the face end of the magnet valve needle remote from the valve seat is designed accordingly.

A further advantageous possibility for pressure balancing of the valve needle is to dispose radial and axial bores in the valve needle, via which the face end of the valve needle remote from the valve seat after the beginning of the opening stroke of the valve needle communicates with a high pressure conduit, which can be connected to the fuel injection line. Thus, additional valves can be dispensed with, which apart from reducing the parts expenditure, decreases the susceptibility to wear and tear.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a schematic design of a fuel injection device and a first exemplary embodiment of a directly triggered injection valve, in which the pressure balancing of the valve needle is controlled via a pressure balancing valve, disposed on the face end of the valve needle remote from the valve seat and having a ball-shaped valve closing member, which opens a connection to the injection line;

FIG. 2 shows a second exemplary embodiment in a detail from FIG. 1, in which the pressure balancing valve is embodied as a pressure balanced seat valve;

DESCRIPTION OF THE PREFERRED EMBODIMENTS

Figure 3:
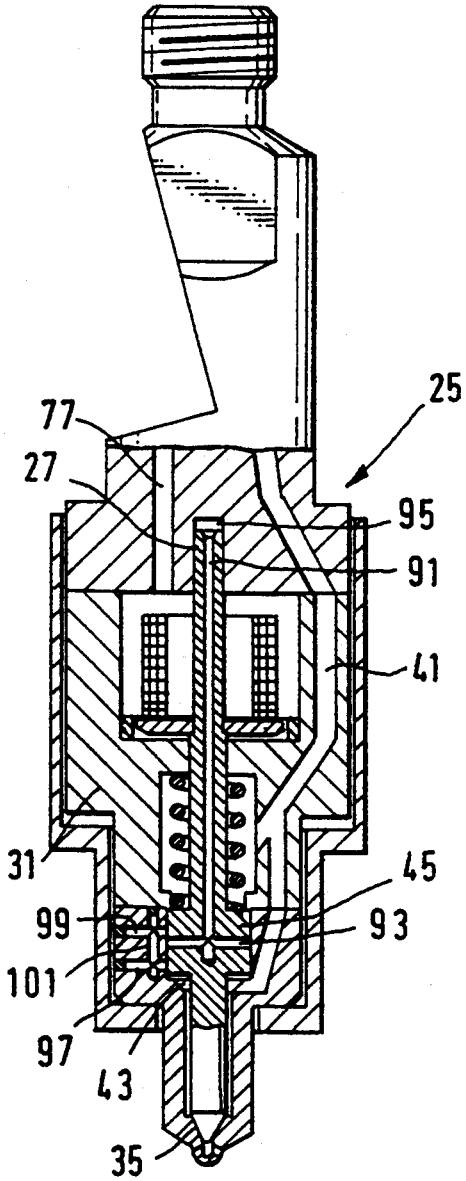
FIG. 3 shows a third exemplary embodiment of the injection valve, in which the pressure balancing of the valve needle is achieved via bores in the valve needle, which can communicate with the injection line.

A pump cylinder 3, which is embodied by a cylinder bore that is closed on its face end, is disposed in a housing 1 of a fuel injection pump, in which cylinder a pump piston 5 is set into a back and forth pumping and aspirating motion by means of a cam drive, not shown. This fuel injection pump can be embodied as a single cylinder plug-in pump, which is disposed on and driven by the internal combustion engine to be supplied. With its face end, the pump piston 5 encloses a pump work chamber 7 in the pump cylinder 3, from which a high pressure fuel line 11, which includes a check valve 9 that closes toward the pump work chamber 7, leads away and feeds into a pressure storage chamber 13. The supply of fuel to the pump work chamber 7 is done via a fuel supply line 17, which begins at a fuel supply tank 15, and feeds into the cylinder wall of the pump cylinder 3 in such a way that the line 17 is closed by means of the pump piston 5 in the course of the pump piston feed stroke. However, any other high pressure pump that makes it possible to compress the fuel to the injection pressure level can be used. To guarantee a constant pressure in the pressure storage chamber 13, a relief line 21, which has a pressure maintenance valve 19, leads from the pressure storage chamber 13 and feeds into the fuel supply tank 15; the standing pressure in the pressure storage chamber 13 can be adjusted via the initial tension of the spring in the pressure maintenance valve 19 (embodied as a controllable valve) so that the desired injection pressure can be quickly set by the control system.

Furthermore, injection lines 23 lead from the pressure storage chamber 13 and connect it with the various injection valves 25, which protrude into each combustion chamber of the engine cylinders to be supplied, and which communicate with one another in common rail fashion via the pressure storage chamber 13.

The injection valves 25 are embodied as injection nozzles whose opening and closing motion is controlled by means of an electrical control valve.

A valve needle 27 is axially displaceably guided to slide in a guide bore 29 of a multiple-part valve housing 31; on its one face end, the valve needle 27 forms a conical sealing face 33, with which it works in conjunction with a conical needle valve seat 35, which is adjoined by a blind bore 37 and injection ports 39 on the side remote from the valve needle 27. Furthermore, a pressure line 41, which communicates with the injection line 23, is disposed in the housing 31; it extends along the valve needle 27 into the region of the needle valve seat 35 and forms an annular high pressure chamber 43 at the valve needle 27, which chamber is produced by means of a widening of the guide bore 29, and is defined on the side remote from the needle valve seat 35 by a needle guide collar 45 at the valve needle 27, which collar slides with its jacket face against the wall of the guide bore 29. A valve spring 47 acts upon the needle guide collar 45 on its side remote from the high pressure chamber 43 and, in the absence of pressure, holds the valve needle 47 with its sealing face 33 in contact with the seat 35. The valve spring 47 is disposed in a spring chamber 49, which is embodied by means of a reenlargement of the diameter of the guide bore 29 and which communicates continuously with the pressure line 41 via a bifurcation. To limit the opening stroke of the valve needle 27, an annular rib 51, which protrudes inward, is disposed in the guide bore 29 between the spring chamber 49 and the annular high pressure chamber 43; after a set opening motion, the collar 45 of the valve needle 27 comes into contact with this annular rib 51.

The injection valve 25 is embodied as a magnet valve and is actuated by an electromagnet 53 disposed in the valve housing 31, whose armature 55 is embodied as a disk firmly connected to the valve needle 27, that works in conjunction with the electromagnet 53, which is embodied as an annular coil. The armature 55 is disposed on the side of the electromagnet 53 oriented toward the valve needle seat 35 and, when current flows through the electromagnet 53, is set in motion in the direction of the electromagnet, counter to the force of the valve spring 47, so that the valve needle 27 connected to the armature 55 executes its opening stroke motion, lifts up from its seat 35, and allows the fuel to flow through into the injection ports 39.

In order to keep the needle adjusting forces as small as possible, the valve needle 27 is pressure balanced in both its open and closed positions, for which purpose in the first exemplary embodiment shown in FIG. 1, a pressure balancing valve 61 is disposed on the end of the valve needle 27 remote from the seat 35, which pressure balancing valve 61 is disposed in a chamber 63, which is embodied in an axial elongation of the guide bore 29 and into which a connecting line 65, which communicates with the pressure line 41, feeds; the pressure balancing valve 61 is embodied as a valve ball 67, which is held in contact with a ball valve seat 71 by a valve spring 69, which ball valve seat 71 is disposed at a flow cross section from the chamber 63 to an end chamber 73 in the guide bore 29. A tang 75 is disposed on the face end of the valve needle 27 remote from the needle valve seat 35; its length is sized so that it has a very small amount of play between it and the valve ball 67 when the injection valve 25 is closed. Immediately after an effective opening stroke of the valve needle 27, this tang 75 lifts the valve ball 67 from its seat 71 counter to the force of the spring 69, so that the high fuel pressure can continue out of the pressure line 41 via the connecting line 65 and the chamber 63 and on into the end chamber.

To allow for an outlet of the overflow fuel flowing along the valve needle 27, an overflow line 77 leads radially out from the valve needle 27; it continues further in the valve housing 31 and communicates via an overflow connection with a return line to the fuel supply tank 15.

The injection valve 25 according to the invention works as follows: In the absence of current in the electromagnet 53, the valve spring 47 holds the valve needle 27 in contact with the needle valve seat 35; the initial tension of the valve spring 47 is designed so that the maximum compression force in the cylinder of the engine cannot lift the valve needle 47 from its seat 35. A force equilibrium then prevails at the valve needle 27, since the diameter of the seat ds is virtually equal to the diameter of the high pressure seal dH, and the pressure balancing chamber 73 on the end is under almost no pressure, so that the surface areas of the valve needle 27 acting in the opening or closing direction of the valve needle 27 and acted upon by the same pressure are virtually equal.

At the beginning of the opening stroke, when the electromagnet 53 is supplied with current, the armature 55 and with it the valve needle 27 are moved toward the electromagnet 53; that is, the valve needle 27 lifts from the needle valve seat 35. Next, a very small stroke of about 0.02 mm is executed, until the tang 75 of the valve needle 27 rests against the valve ball 67 of the pressure balancing valve 61 and opens it. This time lag in the initiation of the injection pressure against the face end of the valve needle 27 remote from the seat 35 is necessary, since at the beginning of the opening stroke motion, the injection pressure is not yet acting on the face end of the valve needle 27 oriented toward the seat 35.

During the further opening stroke, the tang 75 lifts the valve ball 67 from the ball valve seat 71 and the high pressure fuel flows into the chamber 73. The extremely slight delay in the opening of the pressure balancing valve 61 reinforces the opening process of the valve needle 27, since up to this point in time, a high fuel pressure is already being exerted on the blind bore 37.

The opening stroke motion of the valve needle 27 comes to an end when the needle guide collar 45 rests against the annular rib 51; when the valve needle 27 is in this position, a virtual balancing of forces, in terms of the fuel pressure acting on the surfaces of the valve needle 27, takes place by means of the open pressure balancing valve 61.

The pressure drop between the pressure in the region of the bifurcation of the connecting line 65 and that in the pressure line 41 and the valve needle blind bore 37, resulting from the pressure losses in the pressure line 41 during injection, leads to a reduced surplus of force in the closing direction, which can be balanced by means of the choice of the size of the needle stroke stop surface area when it sealingly contacts the annular rib 51; the two forces, i.e. the injection pressure times the needle stroke stop surface area on the annular rib 51, and the pressure drop in the pressure line 41 times the diameter of the needle guide collar 45, must be virtually equal, since the needle stroke stop surface area must be subtracted from the effective surface area in the closing direction of the valve needle 27. In the event that the effective surface area in the closing direction is not sufficient, the pressure balancing diameter dA can be made larger than the diameter of the high pressure seal dH.

Some of the fuel flowing via the pressure balancing valve 61 flows in throttled fashion along the valve needle 27 to the overflow line 77 in order to relieve the end chamber 73 again after the end of injection.

The end of the injection process is achieved by interrupting the supply of current to the electromagnet 53, as a result of which the restoring forces of the valve springs 47 and 67 bring the valve needle 27 into contact with its seat 35; these restoring forces can also be reinforced by means of a small pressure storage chamber connected to the end pressure balancing chamber 73. The pressure in the end pressure balancing chamber 73 decreases via the overflow line 77 when the injection valve 25 is closed.

For simpler manufacture and greater ease of meeting specific requirements, the valve needle 27 can also be embodied in two parts; this division along line 80 has the result of allowing the pressure balancing diameter dA to be embodied larger than the diameter of the high pressure seal dH. Moreover, the tolerance requirements with regard to an alignment of the high pressure sealing surfaces can be made less stringent.

In a section of FIG. 1, FIG. 2 shows a second exemplary embodiment, which differs from the first only in the embodiment of the pressure balancing valve 61, which in this instance is embodied as a pressure balanced seat valve. The valve member 81 is in direct contact with the face end of the valve needle 27 remote from the seat, and the chamber 63 which receives the valve spring 69 constitutes the pressure balancing chamber; when the pressure balancing valve 61 is open, the fuel under high pressure acts on the valve needle 27 via the face end 83 of the valve member 81, which protrudes into the chamber 63. The pressure relief of the pressure balancing valve 61 takes place in the second exemplary embodiment via a throttle line 85 feeding into a return line.

FIG. 3 shows only the injection valve 25 of a third exemplary embodiment, in which pressure balancing takes place by means of control edges. The valve needle 27 has an axial blind bore 91, which leads from its face end remote from the needle valve seat 35; a cross bore 93 feeds into the blind bore 91 in the region of the needle guide collar 45; a remaining space is left over which constitutes a pressure balancing chamber 95 between the face end of the valve needle 27 remote from the seat and the wall of the guide bore 29, which guides this valve needle 27.

Two control bores are let into the valve housing 31, radial to the valve needle 27, of which a lower control bore 97 feeds into the annular high pressure chamber 43 and thus communicates with the pressure line 41 when the valve needle 27 is open. If the valve needle 27 rests on the needle valve seat 35, the communication between the high pressure chamber 43 and the lower control bore 97 is interrupted. The second, or upper control bore 99 is let into the valve housing 31 so that upon the start of the opening stroke motion of the valve needle 27, the upper control bore 99 comes to coincide with the cross bore 93 of the valve needle 27; the upper control bore 99 continuously communicates with the lower control bore 97 via a longitudinal bore 101. As a result, when the valve needle 27 is seated in the valve seat 35, the length of the coincidence is effective at both control bores 97, 99.

The injection valve 25 works analogously to the one described in FIG. 1; when the injection valve 25 is closed, here, too, the pressure balancing chamber 95 is without pressure and consequently the valve needle 27 is force balanced by means of a suitable choice of its measurements.

Immediately after the start of the opening stroke of the valve needle 27, the cross bore 93 of the valve needle 27 comes to coincide with the upper control bore 99 so that the fuel under high pressure flows into the pressure balancing chamber 95, building up a high pressure in the pressure line 41 corresponding to the injection pressure, which results in a balancing of the forces at the valve needle 27. At the end of injection, during the closing motion of the valve needle 27, the cross bore 93 is closed again; the high fuel pressure is reduced in the pressure balancing chamber 95 on the one hand by means of the volume freed by the valve needle 27 and on the other hand via the high pressure seal of the valve needle 27 and the overflow line 77. This exemplary embodiment has the advantage that additional valves can be dispensed with, thus lowering the susceptibility to mechanical failure of the injection valve.

Figure 4:
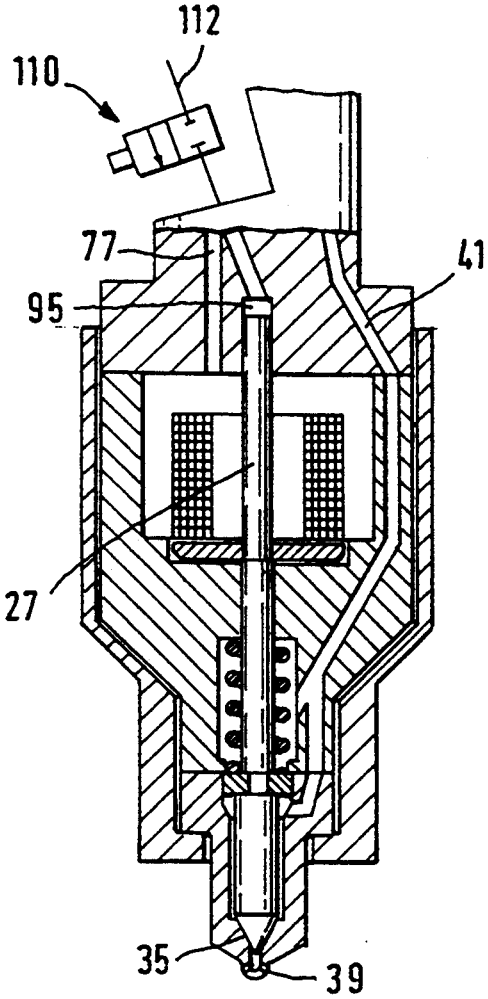
FIG. 4 shows a fourth exemplary embodiment, in which the pressure balancing of the valve needle is controlled via a magnet valve in a connecting line between the injection line and the face end of the valve needle remote from the valve seat.

FIG. 4 shows a fourth exemplary embodiment in which the control of the pressure balancing of the valve needle is achieved, in a modification of the exemplary embodiments in FIGS. 1 and 3, by means of a magnet valve or another valve, for example a piezoelectric element.

A valve 110 is inserted in a pressure balancing line 112, which connects the pressure balancing chamber 95 from FIG. 3, which corresponds to the chamber 73 in FIG. 1, to the injection line 23 on the end of the valve needle 27 remote from the needle valve seat 35; this valve needle 27 is embodied analogously to that in FIG. 1. The magnet valve 110 opens immediately after the start of the valve needle opening stroke and, analogously to the preceding exemplary embodiments, directs the high pressure in the injection line 23 or the pressure line 41 onto the face end of the valve needle 27 remote from the injection ports 39 so that the valve needle 27 is force balanced in its open state. The pressure decrease after the closing of the valve needle 27 takes place, as described in FIGS. 1 and 3, via the high pressure sealing surface at the valve needle 27 and the overflow line 77.

This embodiment of the pressure balancing control of the valve needle 27 by means of a valve has the advantage that by means of a suitable choice of the diameters at the valve needle 27 (pressure balancing surface larger than seat diameter), a forced closing of the valve needle 27 having the valve 110 can be achieved.

With the fuel injection device according to the invention, it is therefore possible, by means of the direct triggering of the valve needle, to control the injection process at the injection valve itself, and thus to reduce to a minimum the time lag between the switching signal and the opening motion of the valve needle, which makes possible a very precise control of the injection times and the injection quantity.

Furthermore, by means of the force balancing of the valve needle in the closed and open position, relatively low needle adjusting forces are required, which is why the valve can be embodied in a small size, which in turn leads to short switching times, with which a pre-injection of fuel can be precisely and reliably controlled.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection device for internal combustion engines having a high pressure fuel pump, a pump work chamber (7), which communicates via a closable fuel supply line (17) with a low pressure chamber (15), which is filled with fuel, and via a high pressure fuel line (11), which has a pressure valve (9), with a pressure storage chamber (13), said storage chamber (13) communicates via injection lines (23) with injection valves (25), each of said injection valves protrude into a combustion chamber of the engine to be supplied, each of said injection valves include a valve member in the form of a spring-loaded valve needle (27) which is disposed in a housing and works in conjunction with a valve seat (35), opening and closing motions of the spring-loaded valve needle being electrically controlled, the spring-loaded valve needle (27) of the injection valve (25) is actuated by means of an electromagnet (53) and the spring-loaded valve needle (27) is permanently, mechanically, and rigidly connected with an armature (55) of the electromagnet, the spring-loaded valve needle (27) includes a surface area which act in the opening direction and against which the fuel flows, during the contact of the spring-loaded valve needle with the valve seat (35) and during its opening stroke the surface area is exactly the same area as the surface areas of the spring loaded valve needle (27) against which the fuel flows in the closing direction, and at a start of the opening stroke of the spring-loaded valve needle (27), a fuel communication is opened between the injection line (23) and a chamber defined by a pressure balancing surface on an end of the spring-loaded valve needle (27) remote from the valve seat.

2. A fuel injection device according to claim 1, in which the communication between the injection line (23) and the chamber at the pressure balancing surface is opened by means of a pressure balancing valve (61), which is inserted into a connection between the injection line (23) and a pressure chamber (73) disposed on the end of the spring-loaded valve needle (27) remote from the valve seat (35), and when the spring-loaded valve needle (27) is lifted up from the valve seat (35), by means of the electromagnet (53), counter to the force of a valve spring (47), this pressure balancing valve (61) is pushed open.

3. A fuel injection device according to claim 2, in which the valve member of the pressure balancing valve (61) is embodied as a ball (67), and a centered tang (75), which protrudes from the end of the valve needle (27) remote from the valve seat (35), is brought into contact with the pressure balancing valve.

4. A fuel injection device according to claim 2, in which the pressure balancing valve (61) is embodied as a seat valve whose valve member (81) rests directly on the valve needle (27) and protrudes with a face end (83) remote from the valve needle (27), into a chamber (63), which has a valve seat, which chamber (63) communicates with the injection line (23, 41) after the opening of the pressure balancing valve (61).

5. A fuel injection device according to claim 1, in which the spring-loaded valve needle (27) has an axial blind bore (91) leading from its face end remote from the valve seat (35), into which bore a cross bore (93) discharges, after the start of the opening stroke motion of the spring-loaded valve needle (27), the cross bore comes to coincide with control bores (97, 99) in the valve housing (31), which communicate with the injection line (23, 41), wherein the face end of the spring-loaded valve needle (27) remote from the seat defines a pressure balancing chamber (95).

6. A fuel injection device according to claim 1, in which the pressure balancing chamber (63, 95) is relieved via a throttled overflow line (77).

7. A fuel injection device according to claim 3, in which the pressure balancing chamber (63, 95) is relieved via a throttled overflow line (77).

8. A fuel injection device according to claim 2, in which the pressure balancing chamber (63, 95) is relieved via a throttled overflow line (77).

9. A fuel injection device according to claim 4, in which the pressure balancing chamber (63, 95) is relieved via a throttled overflow line (77).

10. A fuel injection device according to claim 5, in which the pressure balancing chamber (63, 95) is relieved via a throttled overflow line (77).

11. A fuel injection device according to claim 1, in which the valve needle (27), with its face end remote from the needle valve seat (35), defines a pressure balancing chamber (95), into which a pressure line (112) discharges, which leads from the injection line (23) and can be opened and closed via a valve (110).

12. A fuel injection device according to claim 1, in which the valve needle (27) is embodied in two parts, and the two valve parts each have a different diameter.

13. A fuel injection device according to claim 2, in which the valve needle (27) is embodied in two parts, and the two valve parts each have a different diameter.

14. A fuel injection device according to claim 3, in which the valve needle (27) is embodied in two parts, and the two valve parts each have a different diameter.

15. A fuel injection device according to claim 4, in which the valve needle (27) is embodied in two parts, and the two valve parts each have a different diameter.

16. A fuel injection device according to claim 5, in which the valve needle (27) is embodied in two parts, and the two valve parts each have a different diameter.

17. A fuel injection device according to claim 1, in which the valve needle (27) opens the injection valve (25) via a stroke motion directed inward into the valve housing (31), and that the valve needle (27) is axially guided in a guide bore of the valve housing (31) via a needle guide collar (45) disposed on its circumference.

* * * * *